US011139556B2

(12) United States Patent
Huang

(10) Patent No.: US 11,139,556 B2
(45) Date of Patent: Oct. 5, 2021

(54) ANTENNA STRUCTURE

(71) Applicant: Wistron NeWeb Corp., Hsinchu (TW)

(72) Inventor: Chun-Lin Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 3 days.

(21) Appl. No.: 16/867,946

(22) Filed: May 6, 2020

(65) Prior Publication Data

US 2021/0159586 A1 May 27, 2021

(30) Foreign Application Priority Data

Nov. 22, 2019 (TW) ..... 108142489

(51) Int. Cl.

| | |
|---|---|
| ***H01Q 1/24*** | (2006.01) |
| ***H01Q 13/10*** | (2006.01) |
| ***H01Q 1/48*** | (2006.01) |
| ***H01Q 9/42*** | (2006.01) |
| ***H01Q 9/06*** | (2006.01) |

(52) U.S. Cl.

CPC ..... *H01Q 1/243* (2013.01); *H01Q 1/48* (2013.01); *H01Q 9/06* (2013.01); *H01Q 9/42* (2013.01); *H01Q 13/10* (2013.01)

(58) Field of Classification Search

CPC ..... H01G 1/243; H01G 1/48; H01G 9/06; H01G 13/10; H01G 1/38

See application file for complete search history.

(56) References Cited

U.S. PATENT DOCUMENTS

2013/0169503 A1* 7/2013 Fakharzadeh Jahromi ..... H01Q 19/005 343/833

FOREIGN PATENT DOCUMENTS

| | | |
|---|---|---|
| CN | 104993225 B | 10/2017 |
| CN | 209461638 U | 10/2019 |
| TW | M560708 U | 5/2018 |

* cited by examiner

*Primary Examiner* — Graham P Smith

(74) *Attorney, Agent, or Firm* — McClure, Qualey & Rodack, LLP

(57) ABSTRACT

An antenna structure includes a main radiation element, a first feeding element, a first additional radiation element, a dielectric substrate, and a ground plane. A first signal source is coupled through the first feeding element to a first side of the main radiation element. The first additional radiation element is coupled to a second side of the main radiation element. A first slot is formed between the first additional radiation element and the main radiation element. The second side is different from the first side. The dielectric substrate has a first surface and a second surface which are opposite to each other. The main radiation element, the first feeding element, and the first additional radiation element are disposed on the first surface of the dielectric substrate. The ground plane is adjacent to the second surface of the dielectric substrate.

19 Claims, 9 Drawing Sheets

401

402

403

404

501

502

503

504

505

506

507

508

509

510

ANTENNA STRUCTURE

CROSS REFERENCE TO RELATED APPLICATIONS

This application claims priority of Taiwan Patent Application No. 108142489 filed on Nov. 22, 2019, the entirety of which is incorporated by reference herein.

BACKGROUND OF THE INVENTION

Field of the Invention

The disclosure generally relates to an antenna structure, and more particularly, it relates to a high-gain antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient gain, this tends to degrade the communication quality of the mobile device. Accordingly, it has become a critical challenge for antenna designers to design a high-gain antenna element that is small in size.

BRIEF SUMMARY OF THE INVENTION

In an exemplary embodiment, the disclosure is directed to an antenna structure that includes a main radiation element, a first feeding element, a first additional radiation element, a dielectric substrate, and a ground plane. A first signal source is coupled through the first feeding element to a first side of the main radiation element. The first additional radiation element is coupled to a second side of the main radiation element. A first slot is formed between the first additional radiation element and the main radiation element. The second side is different from the first side. The dielectric substrate has a first surface and a second surface which are opposite to each other. The main radiation element, the first feeding element, and the first additional radiation element are disposed on the first surface of the dielectric substrate. The ground plane is adjacent to the second surface of the dielectric substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
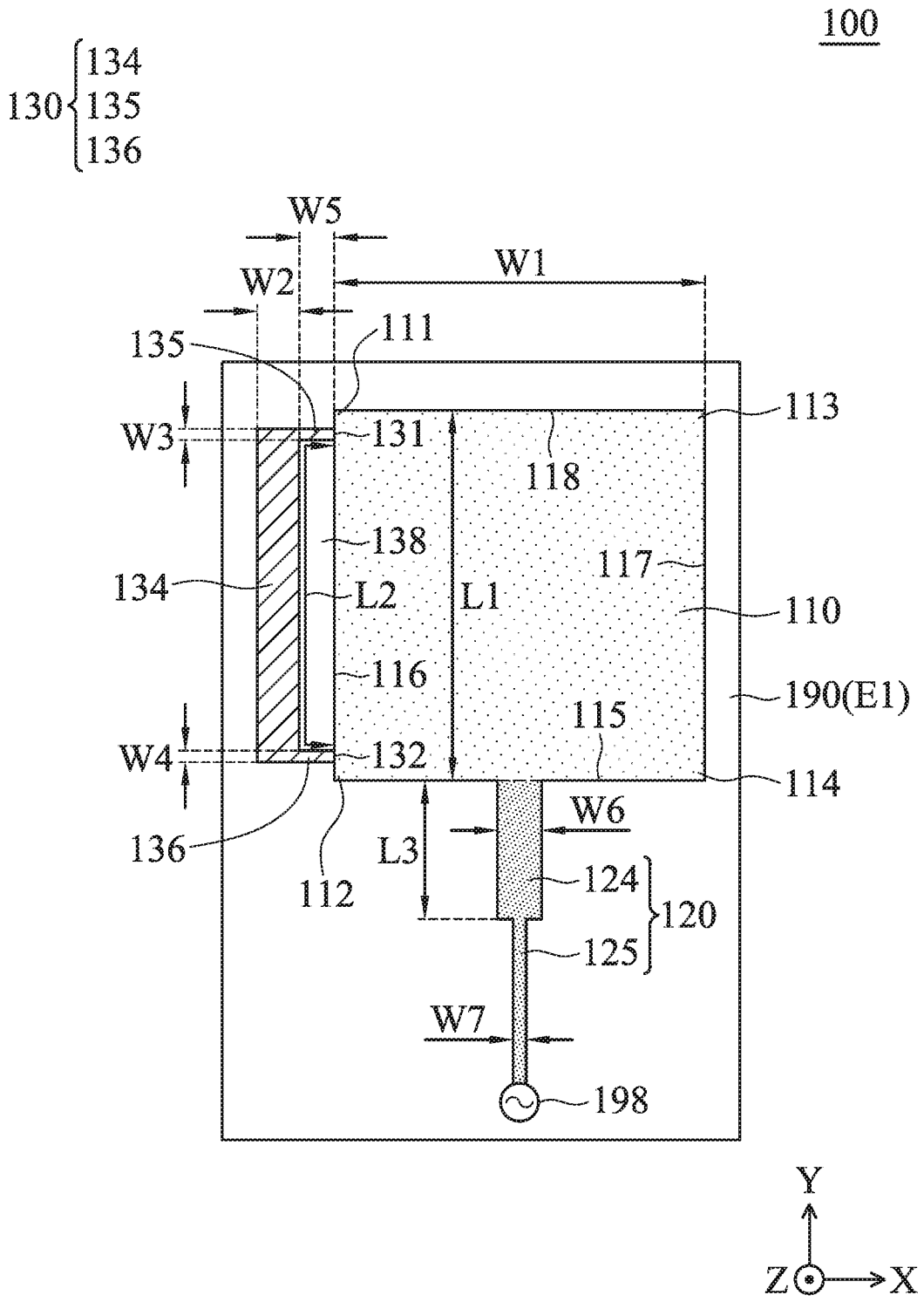
FIG. 1A is a top view of an antenna structure according to an embodiment of the invention.
Figure 1B:
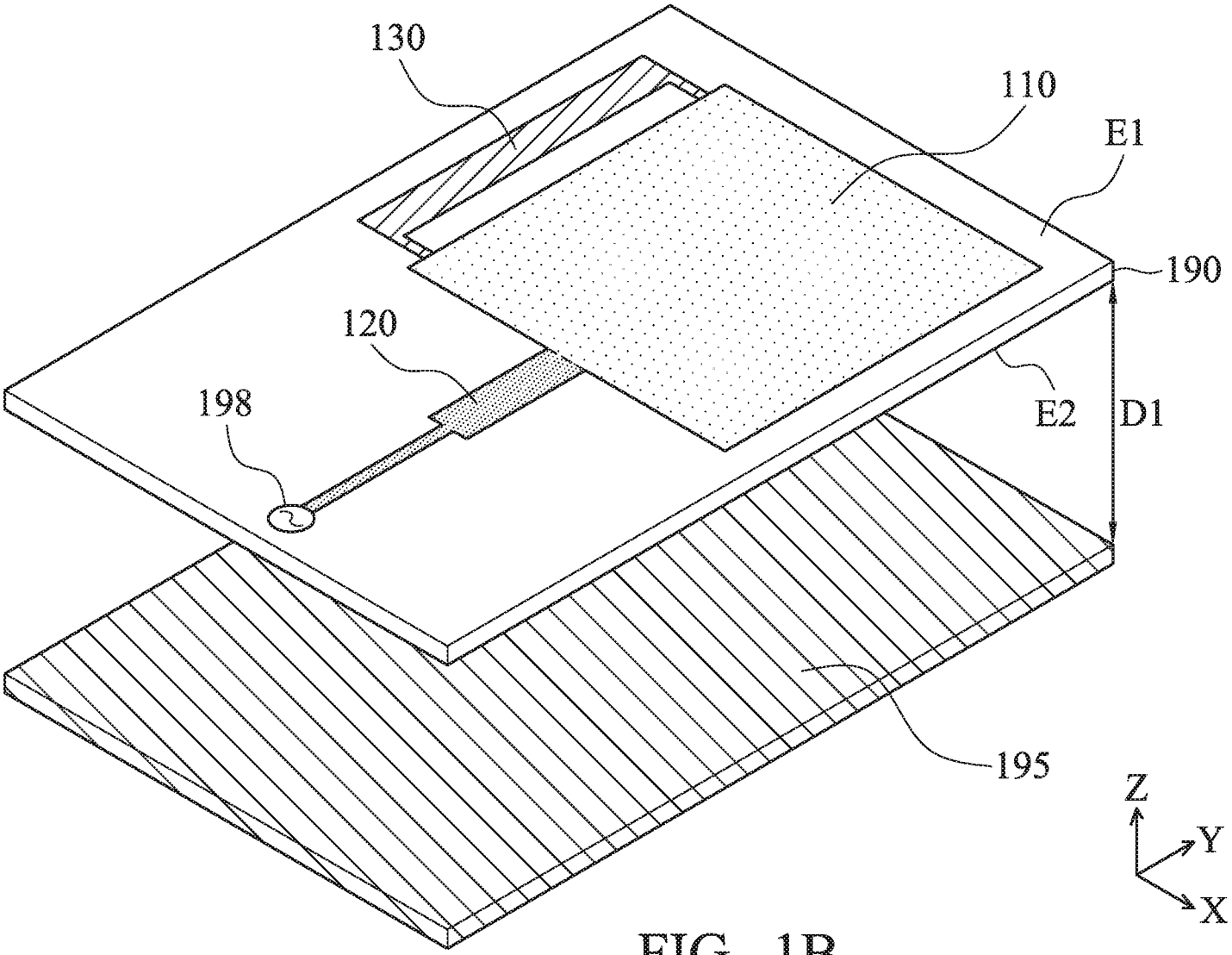
FIG. 1B is a perspective view of an antenna structure according to an embodiment of the invention.

FIG. 1A is a top view of an antenna structure 100 according to an embodiment of the invention. FIG. 1B is a perspective view of the antenna structure 100 according to an embodiment of the invention. Please refer to FIG. 1A and FIG. 1B together. The antenna structure 100 may be applied to a communication device, such as a wireless access point.

As shown in FIG. 1A and FIG. 1B, the antenna structure 100 at least includes a main radiation element 110, a first feeding element 120, a first additional radiation element 130, a dielectric substrate 190, and a ground plane 195. The main radiation element 110, the first feeding element 120, the first additional radiation element 130, and the ground plane 195 may all be made of metal materials, such as copper, silver, aluminum, iron, or their alloys.

The dielectric substrate 190 may be an FR4 (Flame Retardant 4) substrate, a PCB (Printed Circuit Board), or an FCB (Flexible Circuit Board). The dielectric substrate 190 has a first surface E1 and a second surface E2 which are opposite to each other. The main radiation element 110, the first feeding element 120, and the first additional radiation element 130 are all disposed on the first surface E1 of the dielectric substrate 190. The ground plane 195 is adjacent to the second surface E2 of the dielectric substrate 190. It should be noted that the term "adjacent" or "close" over the disclosure means that the distance (spacing) between two corresponding elements is smaller than a predetermined distance (e.g., 10 mm or the shorter), or means that the two corresponding elements directly touch each other (i.e., the aforementioned distance/spacing therebetween is reduced to 0).

The main radiation element 110 may substantially have a rectangular shape or a square shape with a first corner 111, a second corner 112, a third corner 113, and a fourth corner 114 which are different from each other, and a first side 115, a second side 116, a third side 117, and a fourth side 118 which are different from each other. A first signal source 198 is coupled through the first feeding element 120 to the first side 115 of the main radiation element 110. For example, the first signal source 198 may be an RF (Radio Frequency) module for exciting the antenna structure 100. In some embodiments, the first feeding element 120 includes a wide portion 124 and a narrow portion 125 which are coupled to each other, so as to fine-tune the impedance matching of the antenna structure 100. Specifically, the wide portion 124 of the first feeding element 120 may be coupled to the central point of the first side 115 of the main radiation element 110. However, the invention is not limited thereto. In alternative embodiments, the first feeding element 120 has an equal-width structure.

The first additional radiation element 130 may substantially have a U-shape. The first additional radiation element 130 is coupled to the second side 116 of the main radiation element 110. A first slot 138 is formed between the first additional radiation element 130 and the second side 116 of the main radiation element 110. The second side 116 of the main radiation element 110 is adjacent to the first side 115 of the main radiation element 110. Specifically, the first additional radiation element 130 has a first end 131 and a second end 132. The first end 131 of the first additional radiation element 130 is coupled to the first corner 111 of the main radiation element 110. The second end 132 of the first additional radiation element 130 is coupled to the second corner 112 of the main radiation element 110. In some embodiments, the first additional radiation element 130 includes a body portion 134, a first connection portion 135 adjacent to the first end 131, and a second connection portion 136 adjacent to the second end 132. The body portion 134 is coupled between the first connection portion 135 and the second connection portion 136. For example, the body portion 134 main substantially have a relatively wide straight-line shape, and each of the first connection portion 135 and the second connection portion 136 may substantially have a relatively narrow straight-line shape. Furthermore, both the first connection portion 135 and the second connection portion 136 may be substantially perpendicular to the body portion 134. The first connection portion 135 and the second connection portion 136 may be substantially parallel to each other.

According to practical measurements, the antenna structure 100 can cover an operation frequency band from 2400 MHz to 2500 MHz. Therefore, the antenna structure 100 can support at least the wideband operation of WLAN (Wireless Local Area Networks) 2.4 GHz. With respect to the antenna operation principle, when the antenna structure 100 is excited by the first signal source 198, the first additional radiation element 130 can generate resonant currents whose direction is the same as that of the main radiation element 110, thereby enhancing the radiation gain of the antenna structure 100. In alternative embodiments, the antenna structure 100 includes more additional radiation elements for improving the communication quality thereof.

In some embodiments, the element sizes of the antenna structure 100 are described as follows. The length L1 and/or the width W1 of the main radiation element 110 may be from 0.4 to 0.5 wavelength of the operation frequency band of the antenna structure 100 ($0.4\lambda \le L1 \le 0.5\lambda$). The total length L2 of the body portion 134, the first connection portion 135, and the second connection portion 136 of the first additional radiation element 130 may be from 0.7 to 1.3 times the length L1 of the main radiation element 110 ($0.7 \cdot L1 \le L2 \le 1.3 \cdot L1$). The total length L2 of the body portion 134, the first connection portion 135, and the second connection portion 136 of the first additional radiation element 130 may be from 7 to 10 times the width W2 of the body portion 134 ($7 \cdot W2 \le L2 \le 10 \cdot W2$). The width W3 of the first connection portion 135 of the first additional radiation element 130 may be shorter than or equal to 1 mm. The width W4 of the second connection portion 136 of the first additional radiation element 130 may be shorter than or equal to 1 mm. The length L1 of the main radiation element 110 may be at least 8 times the width W5 of the first slot 138 ($L1 \ge 8 \cdot W5$). The length L3 of the wide portion 124 of the first feeding element 120 may be substantially equal to 0.25 wavelength of the operation frequency band of the antenna structure 100 ($L3 = 0.25\lambda$). In first feeding element 120, the width W6 of the wide portion 124 may be from 2 to 4 times the width W7 of the narrow portion 125 ($2 \cdot W7 \le W6 \le 4 \cdot W7$). The distance D1 between the second surface E2 of the dielectric substrate 190 and the ground plane 195 may be from 0 mm to 6 mm. The above ranges of element sizes are calculated according to many experiment results, and they help to optimize the radiation gain, the operation bandwidth, and the impedance matching of the antenna structure 100.

The following embodiments will introduce a variety of designs and configurations of the antenna structure 100. It should be understood that these figures and descriptions are merely exemplary, rather than limitations of the invention.

Figure 2:
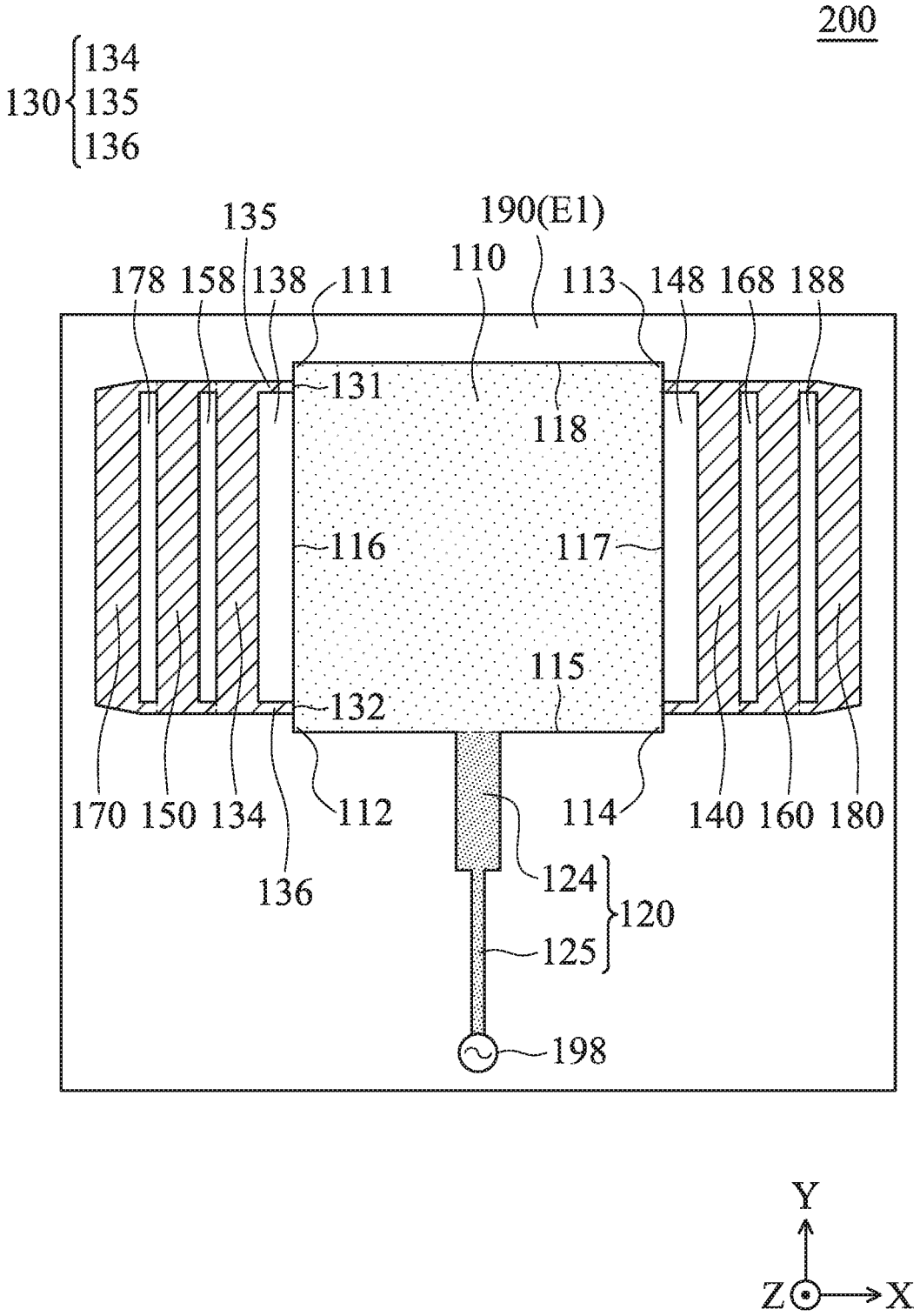
FIG. 2 is a top view of an antenna structure according to an embodiment of the invention.

FIG. 2 is a top view of an antenna structure 200 according to an embodiment of the invention. FIG. 2 is similar to FIG. 1A. In the embodiment of FIG. 2, the antenna structure 200 further includes a second additional radiation element 140, a third additional radiation element 150, a fourth additional radiation element 160, a fifth additional radiation element 170, and a sixth additional radiation element 180, which may all be made of metal materials and disposed on the first surface E1 of the dielectric substrate 190. A first end and a second end of the second additional radiation element 140 are respectively coupled to the third corner 113 and the fourth corner 114 of the main radiation element 110 (or the third side 117 of the main radiation element 110). A second slot 148 is formed between the second additional radiation element 140 and the third side 117 of the main radiation element 110. The third side 117 of the main radiation element 110 is opposite to the second side 116 of the main radiation element 110. A first end and a second end of the third additional radiation element 150 are respectively coupled to two ends of the body portion 134 of the first additional radiation element 130. A third slot 158 is formed between the third additional radiation element 150 and the first additional radiation element 130. A first end and a second end of the fourth additional radiation element 160 are respectively coupled to two ends of a body portion of the second additional radiation element 140. A fourth slot 168 is formed between the fourth additional radiation element 160 and the second additional radiation element 140. A first end and a second end of the fifth additional radiation element 170 are respectively coupled to two ends of a body portion of the third additional radiation element 150. A fifth slot 178 is formed between the fifth additional radiation element 170 and the third additional radiation element 150. A first end and a second end of the sixth additional radiation element 180 are respectively coupled to two ends of a body portion of the fourth additional radiation element 160. A sixth slot 188 is formed between the sixth additional radiation element 180 and the fourth additional radiation element 160. It should be noted that the antenna structure 200 is a symmetrical pattern. The structure of each of the second additional radiation element 140, the third additional radiation element 150, the fourth additional radiation element 160, the fifth additional radiation element 170, and the sixth additional radiation element 180 may be the same as that of the first additional radiation element 130, or may be a mirror image of the first additional radiation element 130. Furthermore, the first slot 138, the second slot 148, the third slot 158, the fourth slot 168, the fifth slot 178, and the sixth slot 188 may substantially have six different straight-line shapes which are substantially parallel to each other. Other features of the antenna structure 200 of FIG. 2 are similar to those of the antenna structure 100 of FIG. 1A and FIG. 1B. Accordingly, the two embodiments can achieve similar levels of performance.

Figure 3:
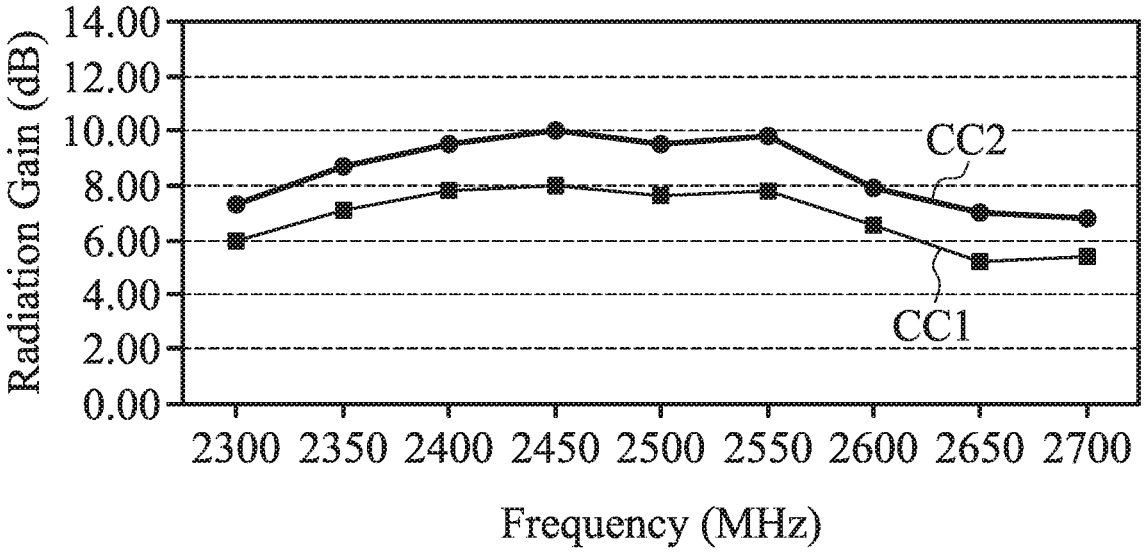
FIG. 3 is a diagram of radiation gain of an antenna structure according to an embodiment of the invention.

FIG. 3 is a diagram of radiation gain of the antenna structure 200 according to an embodiment of the invention. As shown in FIG. 3, a first curve CC1 represents the radiation gain of the antenna structure 200 including no additional radiation element, and a second curve CC2 represents the radiation gain of the antenna structure 200 including the proposed additional radiation elements. According to the measurement of FIG. 3, the proposed additional radiation elements can increase the resonant currents of the antenna structure 200 in the same direction, thereby effectively enhancing its radiation gain by at least 2 dB in the operation frequency band.

Figure 4A:
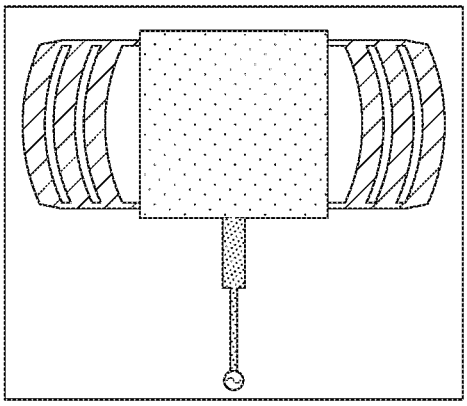
FIG. 4A is a top view of an antenna structure according to an embodiment of the invention.
Figure 4B:
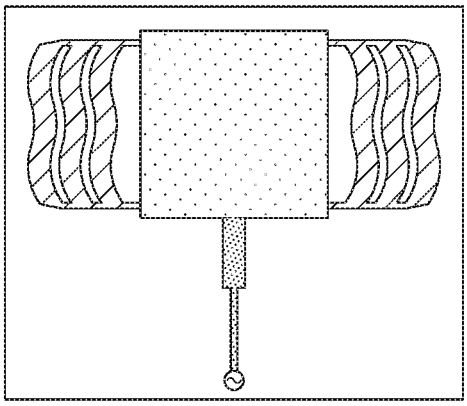
FIG. 4B is a top view of an antenna structure according to an embodiment of the invention.
Figure 4C:
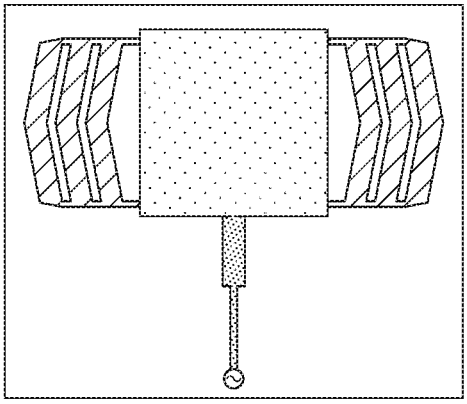
FIG. 4C is a top view of an antenna structure according to an embodiment of the invention.
Figure 4D:
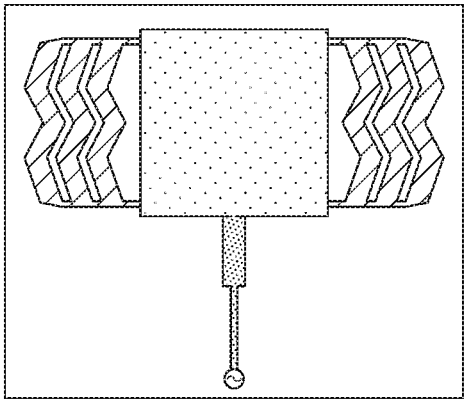
FIG. 4D is a top view of an antenna structure according to an embodiment of the invention.

FIG. 4A is a top view of an antenna structure 401 according to an embodiment of the invention. FIG. 4B is a top view of an antenna structure 402 according to an embodiment of the invention. FIG. 4C is a top view of an antenna structure 403 according to an embodiment of the invention. FIG. 4D is a top view of an antenna structure 404 according to an embodiment of the invention. In the embodiments of FIGS. 4A-4D, each additional radiation element substantially has a circular arc-shape, a wave shape, a V-shape, or a W-shape, but it does not affect the performance of the invention. Other features of the antenna structures 401-404 of FIGS. 4A-4D are similar to those of the antenna structure 200 of FIG. 2. Accordingly, these embodiments can achieve similar levels of performance.

Figure 5A:
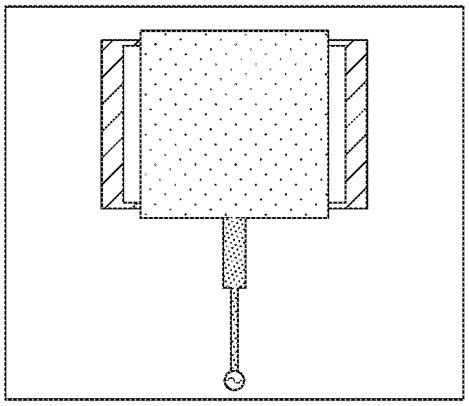
FIG. 5A is a top view of an antenna structure according to an embodiment of the invention.
Figure 5B:
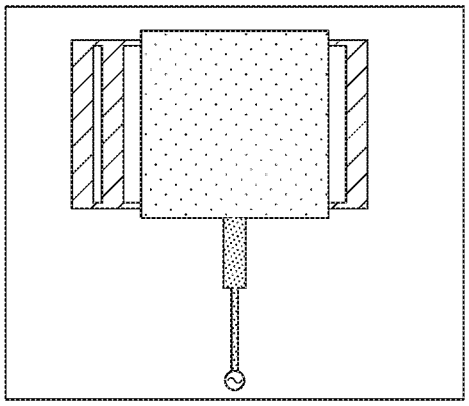
FIG. 5B is a top view of an antenna structure according to an embodiment of the invention.
Figure 5C:
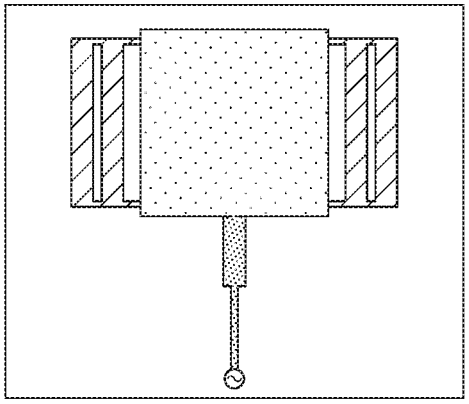
FIG. 5C is a top view of an antenna structure according to an embodiment of the invention.
Figure 5D:
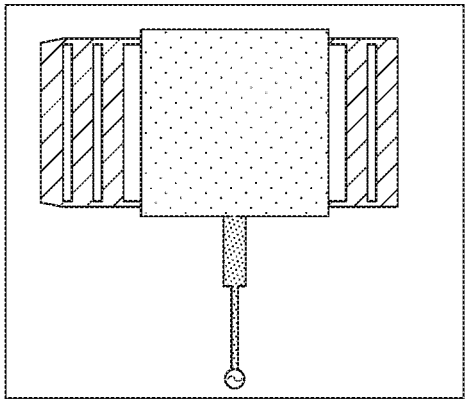
FIG. 5D is a top view of an antenna structure according to an embodiment of the invention.
Figure 5E:
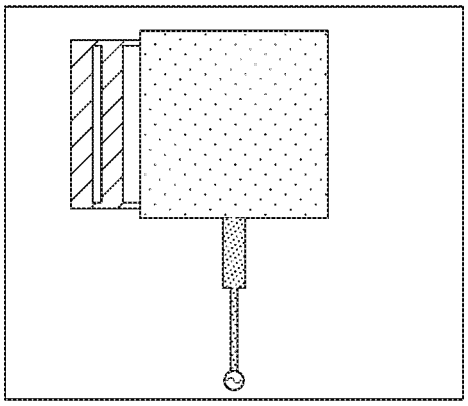
FIG. 5E is a top view of an antenna structure according to an embodiment of the invention.
Figure 5F:
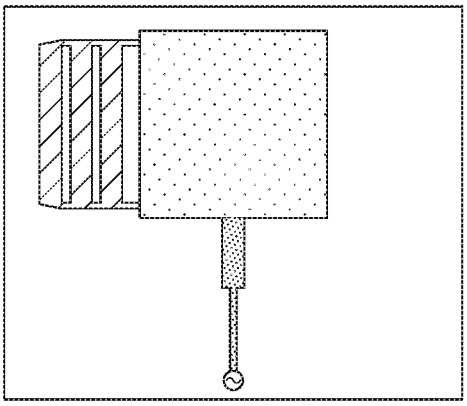
FIG. 5F is a top view of an antenna structure according to an embodiment of the invention.
Figure 5G:
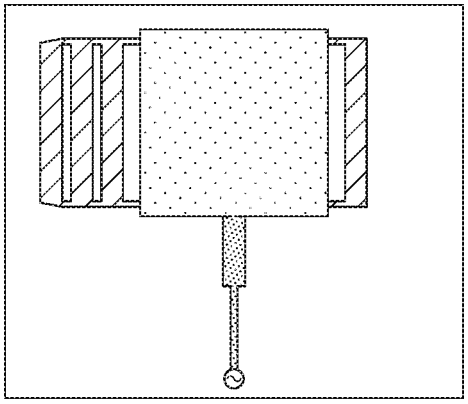
FIG. 5G is a top view of an antenna structure according to an embodiment of the invention.
Figure 5H:
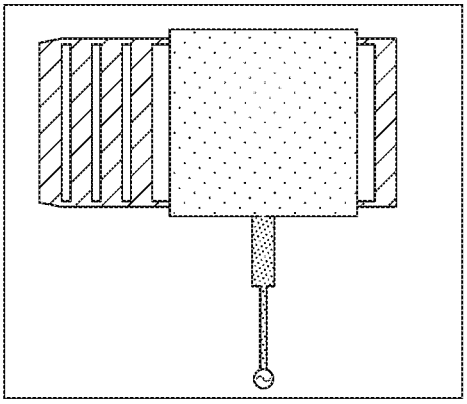
FIG. 5H is a top view of an antenna structure according to an embodiment of the invention.
Figure 5I:
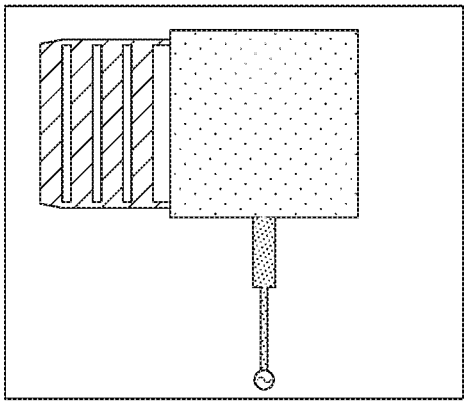
FIG. 5I is a top view of an antenna structure according to an embodiment of the invention.
Figure 5J:
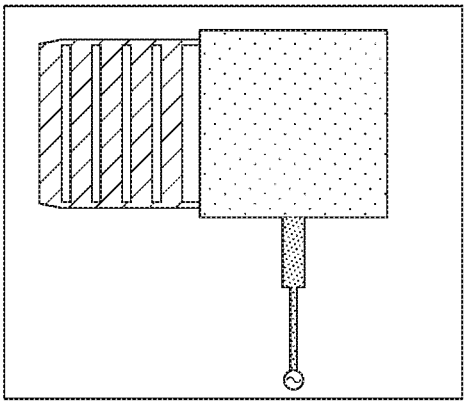
FIG. 5J is a top view of an antenna structure according to an embodiment of the invention.

FIG. 5A is a top view of an antenna structure 501 according to an embodiment of the invention. FIG. 5B is a top view of an antenna structure 502 according to an embodiment of the invention. FIG. 5C is a top view of an antenna structure 503 according to an embodiment of the invention. FIG. 5D is a top view of an antenna structure 504 according to an embodiment of the invention. FIG. 5E is a top view of an antenna structure 505 according to an embodiment of the invention. FIG. 5F is a top view of an antenna structure 506 according to an embodiment of the invention. FIG. 5G is a top view of an antenna structure 507 according to an embodiment of the invention. FIG. 5H is a top view of an antenna structure 508 according to an embodiment of the invention. FIG. 5I is a top view of an antenna structure 509 according to an embodiment of the invention. FIG. 5J is a top view of an antenna structure 510 according to an embodiment of the invention. In the embodiments of FIGS. 5A-5J, each antenna structure includes fewer or more additional radiation elements arranged to form a symmetrical or asymmetrical pattern, but it does not affect the performance of the invention. Other features of the antenna structures 501-510 of FIGS. 5A-5J are similar to those of the antenna structure 100 of FIG. 1A and FIG. 1B. Accordingly, these embodiments can achieve similar levels of performance.

Figure 6:
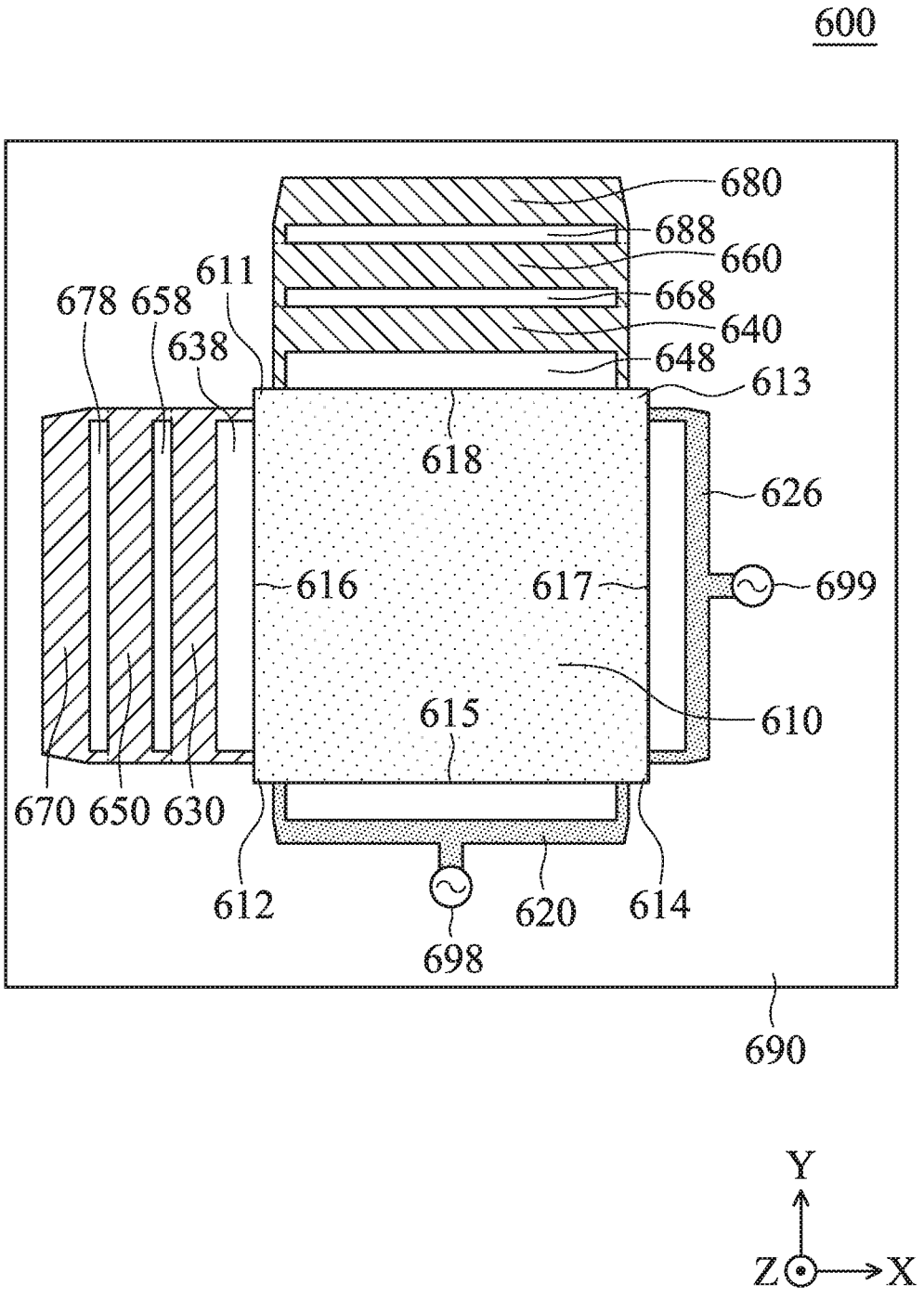
FIG. 6 is a top view of an antenna structure according to an embodiment of the invention.

FIG. 6 is a top view of an antenna structure 600 according to an embodiment of the invention. FIG. 6 is similar to FIG. 1A. In the embodiment of FIG. 6, the antenna structure 600 includes a main radiation element 610, a first feeding element 620, a second feeding element 626, a first additional radiation element 630, a second additional radiation element 640, a third additional radiation element 650, a fourth additional radiation element 660, a fifth additional radiation element 670, a sixth additional radiation element 680, a dielectric substrate 690, and a ground plane (not shown). The main radiation element 610 has a first corner 611, a second corner 612, a third corner 613, and a fourth corner 614 which are different from each other, and a first side 615, a second side 616, a third side 617, and a fourth side 618 which are different from each other. Each of the first feeding element 620 and the second feeding element 626 may be a bifurcated structure, which may almost have a Y-shape. A first signal source 698 is coupled through the first feeding element 620 to the second corner 612 and the fourth corner 614 of the main radiation element 610 (or the first side 615 of the main radiation element 610). A second signal source 699 is coupled through the second feeding element 626 to the third corner 613 and the fourth corner 614 of the main radiation element 610 (or the third side 617 of the main radiation element 610). A first end and a second end of the first additional radiation element 630 are respectively coupled to the first corner 611 and the second corner 612 of the main radiation element 610. A first slot 638 is formed between the first additional radiation element 630 and the second side 616 of the main radiation element 610. The second side 616 of the main radiation element 610 is opposite to the third side 617 of the main radiation element 610. A first end and a second end of the second additional radiation element 640 are respectively coupled to the first corner 611 and the third corner 613 of the main radiation element 610. A second slot 648 is formed between the second additional radiation element 640 and the fourth side 618 of the main radiation element 610. The fourth side 618 of the main radiation element 610 is opposite to the first side 615 of the main radiation element 610. A first end and a second end of the third additional radiation element 650 are respectively coupled to two ends of a body portion of the first additional radiation element 630. A third slot 658 is formed between the third additional radiation element 650 and the first additional radiation element 630. A first end and a second end of the fourth additional radiation element 660 are respectively coupled to two ends of a body portion of the second additional radiation element 640. A fourth slot 668 is formed between the fourth additional radiation element 660 and the second additional radiation element 640. A first end and a second end of the fifth additional radiation element 670 are respectively coupled to two ends of a body portion of the third additional radiation element 650. A fifth slot 678 is formed between the fifth additional radiation element 670 and the third additional radiation element 650. A first end and a second end of the sixth additional radiation element 680 are respectively coupled to two ends of a body portion of the fourth additional radiation element 660. A sixth slot 688 is formed between the sixth additional radiation element 680 and the fourth additional radiation element 660. In some embodiments, the first signal source 698 and the second signal source 699 have the same feeding phase. That is, the feeding phase difference between the first signal source 698 and the second signal source 699 is equal to 0. When the antenna structure 600 is excited by the first signal source 698 and the second signal source 699, the antenna structure 600 can provide both of a vertically-polarized direction (e.g., parallel to the Y-axis) and a horizontally-polarized direction (e.g., parallel to the X-axis). The first additional radiation element 630, the third additional radiation element 650, and the fifth additional radiation element 670 are configured to enhance the radiation gain in the vertically-polarized direction. The second additional radiation element 640, the fourth additional radiation element 660, and the sixth additional radiation element 680 are configured to enhance the radiation gain in the horizontally-polarized direction. Accordingly, the antenna structure 600 can support at least the dual-polarized and high-gain operations. Other features of the antenna structure 600 of FIG. 6 are similar to those of the antenna structure 100 of FIG. 1A and FIG. 1B. Accordingly, the two embodiments can achieve similar levels of performance.

The invention proposes a novel antenna structure including a main radiation element and one or more additional radiation element(s). According to practical measurements, the additional radiation element(s) and the main radiation element can generate resonant currents in the same direction, so as to increase the radiation gain of the antenna structure. In conclusion, the invention has at least the advantages of small size, high gain, and low manufacturing cost, and therefore it is suitable for application in a variety of communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-6. The invention may merely include any one or more features of any one or more embodiments of FIGS. 1-6. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a main radiation element;

a first feeding element, wherein a first signal source is coupled through the first feeding element to a first side of the main radiation element;

a first additional radiation element, coupled to a second side of the main radiation element, wherein a first slot is formed between the first additional radiation element and the main radiation element, and the second side is different from the first side;

a dielectric substrate, having a first surface and a second surface opposite to each other, wherein the main radiation element, the first feeding element, and the first additional radiation element are disposed on the first surface of the dielectric substrate; and a ground plane, disposed adjacent to the second surface of the dielectric substrate;

wherein a length or a width of the main radiation element is from 0.4 to 0.5 wavelength of an operation frequency band of the antenna structure.

2. The antenna structure as claimed in claim 1, wherein the operation frequency band is from 2400 MHz to 2500 MHz.

3. The antenna structure as claimed in claim 1, wherein the main radiation element substantially has a rectangular shape or a square shape with a first corner, a second corner, a third corner, and a fourth corner.

4. The antenna structure as claimed in claim 1, wherein the first additional radiation element substantially has a U-shape.

5. The antenna structure as claimed in claim 3, wherein the first additional radiation element has a first end coupled to the first corner of the main radiation element, and a second end coupled to the second corner of the main radiation element.

6. The antenna structure as claimed in claim 1, wherein the first additional radiation element comprises a body portion, a first connection portion, and a second connection portion, and the body portion is coupled between the first connection portion and the second connection portion.

7. The antenna structure as claimed in claim 6, wherein both the first connection portion and the second connection portion are substantially perpendicular to the body portion.

8. The antenna structure as claimed in claim 6, wherein the first connection portion and the second connection portion are substantially parallel to each other.

9. The antenna structure as claimed in claim 6, wherein a total length of the body portion, the first connection portion, and the second connection portion is from 0.7 to 1.3 times a length of the main radiation element.

10. The antenna structure as claimed in claim 6, wherein a total length of the body portion, the first connection portion, and the second connection portion is from 7 to 10 times a width of the body portion.

11. The antenna structure as claimed in claim 6, wherein a width of each of the first connection portion and the second connection portion is shorter than or equal to 1 mm.

12. The antenna structure as claimed in claim 1, wherein a length of the main radiation element is at least 8 times a width of the first slot.

13. The antenna structure as claimed in claim 2, wherein the first feeding element comprises a wide portion and a narrow portion coupled to each other.

14. The antenna structure as claimed in claim 13, wherein a length of the wide portion is substantially equal to 0.25 wavelength of the operation frequency band.

15. The antenna structure as claimed in claim 3, further comprising:

a second additional radiation element, coupled to a third side or a fourth side of the main radiation element, wherein a second slot is formed between the second additional radiation element and the main radiation element, and the third side and the fourth side are different from the first side and the second side.

16. The antenna structure as claimed in claim 15, wherein the second additional radiation element has a first end coupled to the third corner of the main radiation element, and a second end coupled to the first corner or the fourth corner of the main radiation element.

17. The antenna structure as claimed in claim 15, further comprising:

a third additional radiation element, coupled to the first additional radiation element, wherein a third slot is formed between the third additional radiation element and the first additional radiation element;

a fourth additional radiation element, coupled to the second additional radiation element, wherein a fourth slot is formed between the fourth additional radiation element and the second additional radiation element;

a fifth additional radiation element, coupled to the third additional radiation element, wherein a fifth slot is formed between the fifth additional radiation element and the third additional radiation element; and a sixth additional radiation element, coupled to the fourth additional radiation element, wherein a sixth slot is formed between the sixth additional radiation element and the fourth additional radiation element.

18. The antenna structure as claimed in claim 1, further comprising:

a second feeding element, wherein a second signal source is coupled through the second feeding element to the main radiation element.

19. The antenna structure as claimed in claim 18, wherein each of the first feeding element and the second feeding element is a bifurcated structure.

* * * * *